United States Patent [19]

Bost et al.

[11] 3,998,740

[45] Dec. 21, 1976

[54] APPARATUS FOR TREATMENT OF TEXTILE DESIZING EFFLUENT

[75] Inventors: Curtis C. Bost; Eugene Scott Irwin, both of Clemson; Thomas M. Keineth; Robert Q. Russell, both of Seneca; Harsch C. Ince, Jr., Greenville, all of S.C.; Gary L. Parsons, Gastonia; James Keith Turner, Lincolnton, both of N.C.

[73] Assignees: J. P. Stevens & Co., Inc., New York, N.Y.; Gaston County Dyeing Machine Company, Mount Holly, N.C.

[22] Filed: July 26, 1974

[21] Appl. No.: 492,173

[52] U.S. Cl. ..... 210/195 S; 210/257 R; 210/321 R; 210/433 M

[51] Int. Cl.[2] ..... B01D 31/00

[58] Field of Search ..... 210/23, 257, 258, 195, 210/433, 321

[56] References Cited

UNITED STATES PATENTS

| | | | |
|---|---|---|---|
| 3,528,901 | 9/1970 | Wallace et al. | 210/23 X |
| 3,749,657 | 2/1973 | Bras et al. | 210/23 X |
| 3,758,405 | 9/1973 | Fremont | 210/23 |
| 3,795,609 | 3/1974 | Hill et al. | 210/23 |
| 3,836,457 | 9/1974 | Gross et al. | 210/23 |
| 3,847,804 | 11/1974 | Delpico | 210/23 |
| 3,856,569 | 12/1974 | Strung | 210/23 X |

*Primary Examiner*—Frank A. Spear, Jr.
*Attorney, Agent, or Firm*—Richards, Shefte & Pinckney

[57] ABSTRACT

Apparatus is disclosed for treating textile desizing effluent so as to provide effective pollution abatement, and to render feasible the recovery of sizing material from the effluent for reuse as well as the conditioning of the effluent so that it may be recycled for desizing purposes.

6 Claims, 10 Drawing Figures

APPARATUS FOR TREATMENT OF TEXTILE DESIZING EFFLUENT

CROSS-REFERENCES TO RELATED APPLICATIONS

Copending application Ser. No. 492,267 filed July 26, 1974, discloses the improved hyperfiltration module sealing arrangement developed for the purposes of the present invention and also disclosed herein.

BACKGROUND OF THE INVENTION

The growing emphasis in recent years on measures to deal with water pollution problems has led to a substantial displacement of starch as the previously established standard cotton textile sizing material because of its inordinately high biological or biochemical oxygen demand value (BOD). In addition, the greatly increasing use of polyester fibers, either in blends with cotton or by itself, in the manufacture of textile fabrics has made it more difficult to obtain adequate adhesion with a starch size.

A notable alternative sizing material providing significant advantage in dealing with both of these problems is polyvinyl alcohol, which has a much reduced BOD value as well as adhering well to polyester. However, the chemical oxygen demand (COD) of polyvinyl alcohol is still appreciable and currently proposed anti-pollution standards make it necessary to avoid stream or sewer dumping of effluent from desizing operations where this alternative sizing material or others of the same sort, such as carboxymethycellulose, are used just as fully as when starch is used for sizing.

The present invention provides for handling desizing effluent in compliance with the anti-pollution standards now in prospect in a practical manner which allows advantageous recovery of the sizing material for reuse and recycling of the remaining effluent for desizing purposes.

SUMMARY OF THE INVENTION

Briefly characterized, the treatment of textile desizing effluent according to the present invention involves separation of the sizing material from the effluent in a closed loop system that returns the stripped effluent to the desizing operation. Usually, as where the size is polyvinyl alchohol, the desizing operation will be an aqueous washing procedure and the effluent will be spent wash water containing the removed size. The closed loop system provided by the invention directs this wash water effluent to selective separation means by which enough water is extracted to concentrate the contained size for recovery while making the extracted water available for recycling to the desizing operation by the system.

The selective separation means employed operates on the basis of molecular weight so as to concentrate the size by rejecting its complex molecule while passing water to produce the aqueous extract for recycling. A hyperfiltration device is preferably employed as the selective separation means because the semipermeable membrane of such a device can be selected to modulate the separation so that degraded portions of the sizing material are passed along with the extracted water to improve significantly the reuse potential of the size rejected for recovery, as is noted further in describing the invention in detail below.

DETAILED DESCRIPTION OF THE INVENTION

Figure 1:
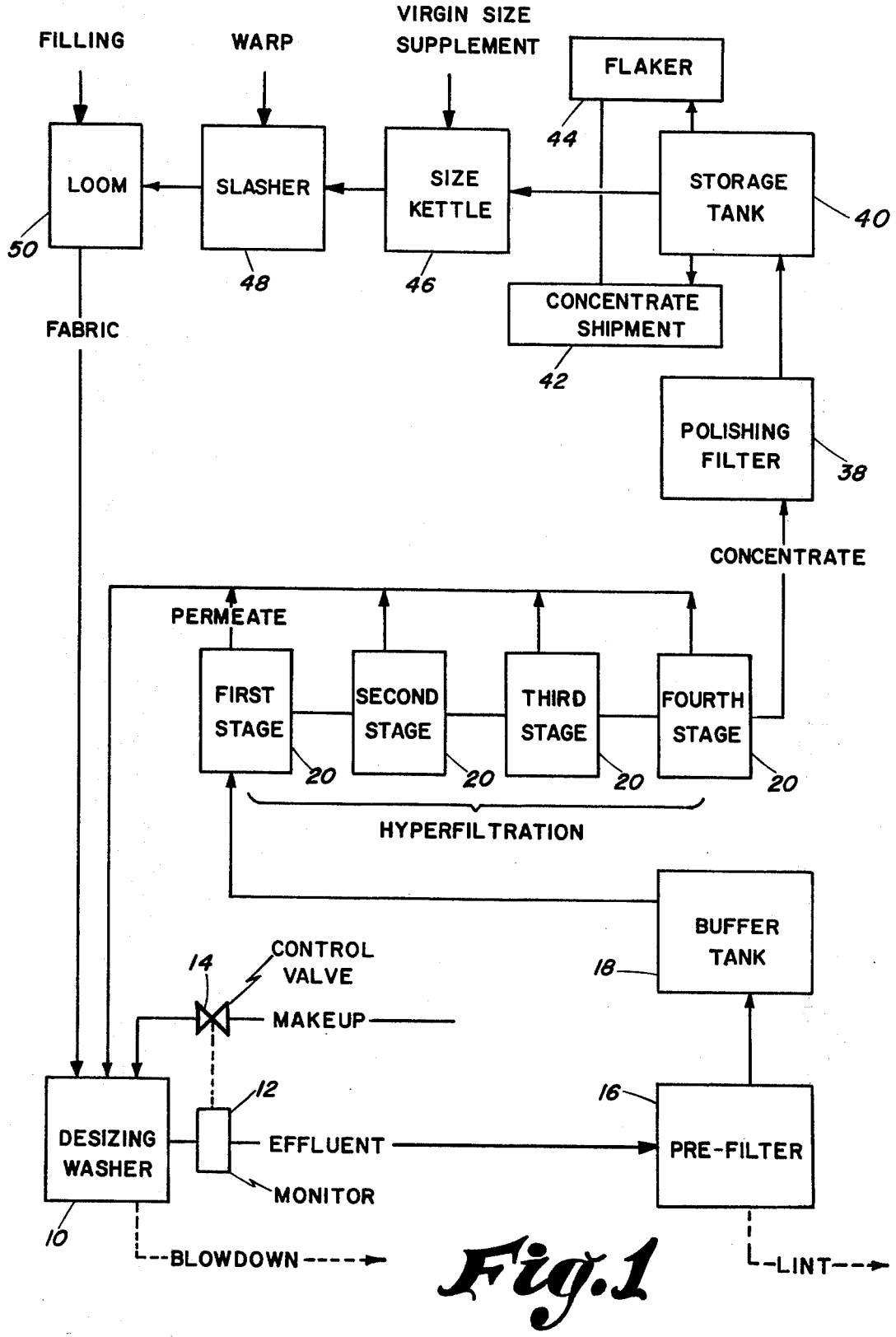
FIG. 1 is a flow diagram of a desizing effluent treating system embodying the present invention.

Consideration of the treating system arrangement diagrammed in FIG. 1 of the drawings should begin with the desizing washer 10 from which the effluent comes that is treated by the system. The "blowdown" indicated in FIG. 1 as leaving the system of the desizing washer 10 represents overflow wasting that is necessary, in addition to normal system losses, to avoid size buildup in the system, as will appear further presently, and to allow a substantially level size content to be maintained in the washing liquid effluent for the purposes of the present invention. The relative amount of this overflow wasting will usually be so small as to raise no pollution problem, but if it does the problem can be dealt with readily by combining it with the washer effluent for treatment in the system and making the necessary provision against size buildup by disposing appropriately of a compensating amount of the size concentrate subsequently obtained.

The desizing washer 10 may have any suitable form desired, and any washing liquid or sizing material may be used. As water is the usual washing liquid employed, and as the treating system of the present invention has been reduced to practice with polyvinyl alcohol desizing effluent, it will be assumed that the effluent is aqueous and polyvinyl alcohol is the sizing material in proceeding with the system description.

Because the weight of fabric being desized can change substantially from batch to batch, the size concentration in the desizing effluent usually varies widely, whereas efficient operation of the treating system of the present invention requires that this concentration be maintained substantially constant. Accordingly, provision is made at the desizing washer 10 to monitor the effluent as indicated at 12 and regulate the addition of makeup water, through a control valve at 14, in relation to this monitoring. Alternatively, the feed of recycled permeate to the desizing operation might be regulated instead, but water conservation considerations will normally favor regulating the makeup water. Monitoring of the desizing effluent concentration is suitably accomplished with a comparator unit operating on the basis of refractive index to sense the size content. It would also be possible to adjust the makeup water feed acceptably as a function of the weight fabric being desized, but monitoring of the effluent is preferable because it provides a continual check on size concentration. Maintenance of a substantially even concentration of size in the effluent is necessary according to the present invention for efficient operation of the treating system at the size recovery stage. An effluent size concentration of about 1% will normally be a practically convenient level to maintain.

The thus controlled desizing effluent at substantially level size content is directed first to a pre-filter unit 16 by which foreign particles are removed prior to size recovery treatment. In the case of spun yarn fabrics the foreign particles removed from the desizing effluent will consist largely of lint, which leaves the system at filter 16 as indicated in FIG. 1. A vibrating screen filter removes the lint effectively as a damp mass which can be disposed of readily. Where filament yarn fabrics are being desized foreign particle continuation of the effluent is not nearly as great, but it is still advisable to employ the prefiltering step as a means of guarding against accumulation of extraneous matter in the system.

Filtered effluent from the pre-filter 16 is collected in a buffer tank 18 for supplying the size recovery operation that follows. Buffer tank 18 serves the purpose of allowing an even feed for size recovery despite the cyclic nature of the desizing washer 10 operation in handling successive fabric batches. The size recovery operation involves concentrating and separating a predominant portion of the effluent size content in a effluent portion so that the remaining effluent can be recycled for desizing use. Such concentration and separation can be effected by any of a number of available procedures, such as evaporation or reverse osmosis, but the preferred procedure employed according to the present invention is hyperfiltration in which selective separation is obtained on the basis of molecular weight because a procedure of this sort can be modulated to recover size in a particularly advantageous manner for reuse.

The hyperfiltration units 20 preferably used to obtain this advantage in the treating system of the present invention incorporate porous carbon tube supported semipermeable membranes of the sort described in the March 1974 issue of Product Engineering at page 13. Modulation of the selective separation obtained with this type of hyperfiltration element is accomplished by choosing the membrane for the separation result desired. The particular advantage for present purposes that is obtained with such hyperfiltration elements appears to result from the ability of a properly selected membrane to provide a high percentage rejection of sizing material having a complex molecule, such as that of polyvinyl alcohol, while allowing degraded or short chain portions thereof to pass through with the effluent permeate.

This apparent result has likely significance because the sizing material is subjected to sufficient heat during slasher application, singeing of the woven fabric, and subsequent desizing, to expect some degradation, and chromatographic analysis for molecular weight distribution not only indicates such degradation but also serves to demonstrate an appreciable elimination of the resulting short chain portions during size recovery. Thus, upon such analysis of polyvinyl alcohol samples of desizing washer effluent at 1% concentration (Sample A), of a 4% concentration of the effluent (Sample B), of a further concentration of the effluent to 8.25% (Sample C), and of the virgin polyvinyl alcohol, produced the results tabulated as follows:

APPARENT MOLECULAR WEIGHT DISTRIBUTION

| Sample | Low | Mean | High | Below 10,565 | Below 31,625 |
|---|---|---|---|---|---|
| A | 2,291 | 165,200 | 631,000 | 4.0% | 11.8% |
| B | 3,981 | 193,700 | 602,600 | 0.7% | 2.7% |
| C | 6,918 | 151,800 | 602,600 | 0.2% | 3.3% |
| D | 18,190 | 204,000 | 631,000 | 0% | 0.6% |

While the foregoing molecular weight values are apparent values that should be understood to have significance mainly in a relative sense, the relations shown demonstrate a marked change at the low side of the molecular dispersity toward the distribution of the virgin sample (*d*) as the desizing effluent is concentrated, and it is believed that this circumstance accounts for the excellent reuse results noted further below that are obtained with size recovered in accordance with the present invention.

A representative arrangement for a hyperfiltration unit 20 suited for use in the treating system of the present invention is diagramed in FIG. 2 as comprising a main circulation pump 22 piped for recirculation of desizing effluent in a loop 24 containing two hyperfiltration modules 26 such as are detailed further in FIGS. 5–10 and will be additionally described below in connection with those drawing figures. Desizing effluent is delivered to the hyperfiltration unit 20 by an injection pump 28 connected with loop 24 in series with the main circulating pump 22 ahead of the filtration surfaces. Recirculating flow is maintained in loop 24 at a rate of about 2,000 gallons per minute resulting in a flow velocity of about 15 feet per second along the filtration surfaces.

Permeate consisting of the filtered effluent portion that passes through the filtration surfaces leaves the modules 26 continually and is recycled to the desizing washer 10, as indicated in FIG. 1, while the circulating effluent portion remaining in loop 24 at a proportionately increasing size concentration is taken off under the control of a valve 30 when its concentration has reached a suitable level or the level corresponding to the optimum capability of the hyperfiltration unit 20, the control valve 30 being employed to regulate the take off rate so that the concentration is maintained at this level. For the most efficient use of filtration surface area in size recovery, hyperfiltration units 20 are employed in serially arranged stages as indicated in FIG. 1 and as will be noted further presently. Upon leaving the hyperfiltration means, or whatever other concentration means is employed, a bactericide is preferably added to the recovered size concentrate in quantities of about 0.075%, as from a supply tank at 32 through a flow meter 34 under the control of a valve 36 (see FIG. 2), so that bacteriological activities, and particularly odor, are effectively dealt with.

Figure 3:
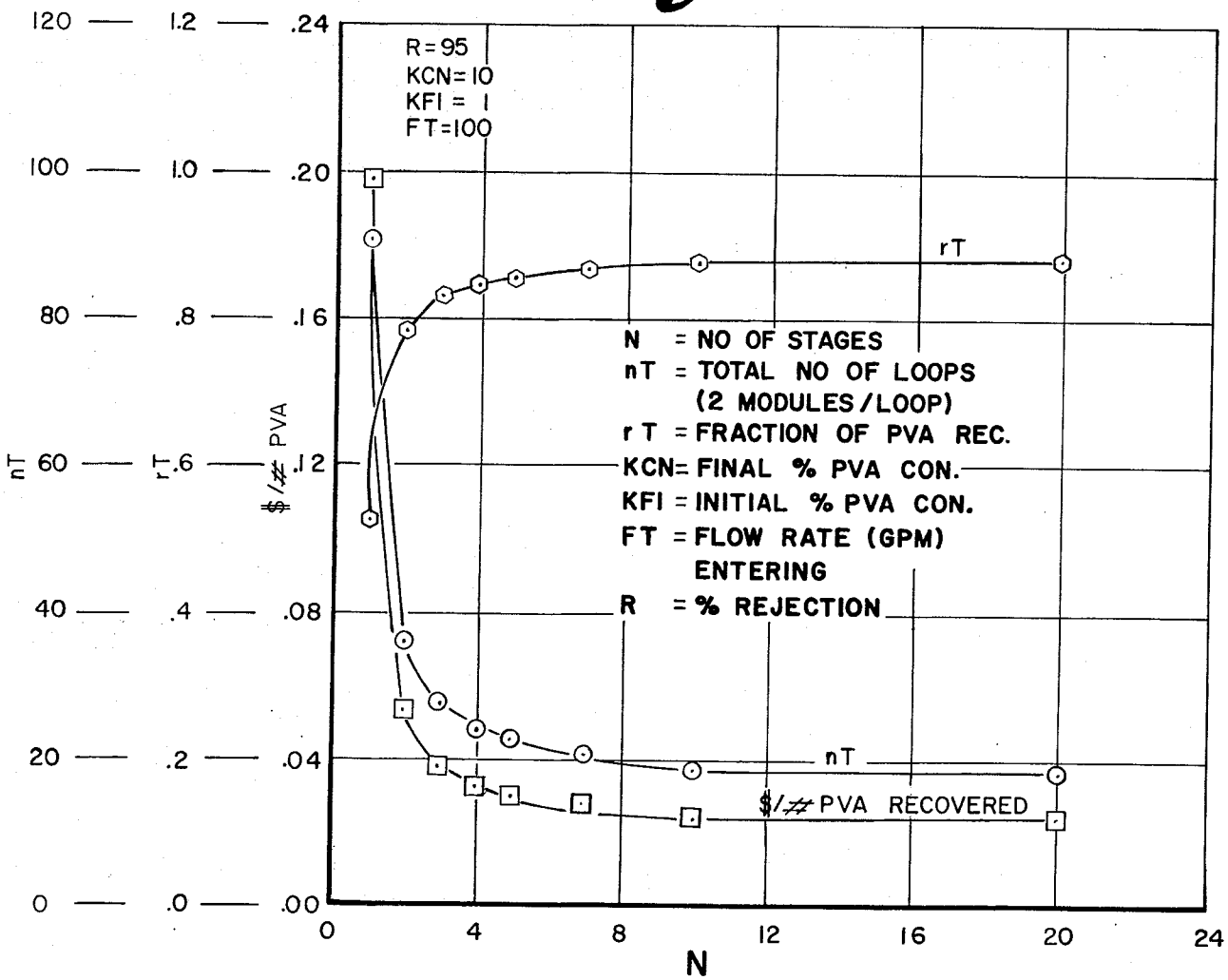
FIG. 3 is a graphical representation of the effect of serially arranged staging of hyperfiltration loops.
Figure 4:
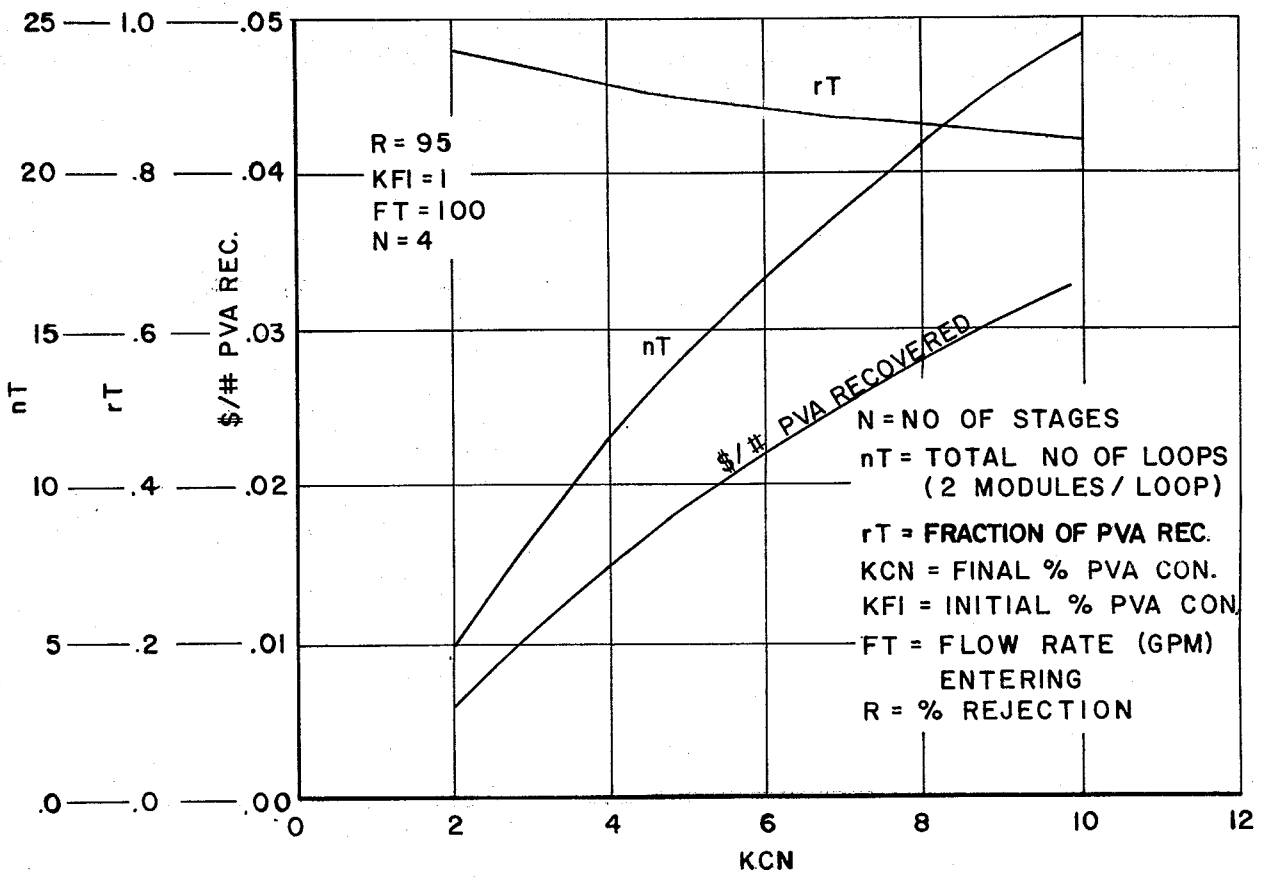
FIG. 4 is a graphical representation of the variation of pertinent factors when percentage concentration of recovered size is increased while using a given number of loop stages.

The significance of arranging hyperfiltration units 20 in stages is graphically illustrated in FIGS. 3 and 4. For plant design purposes it is assumed in FIG. 3 that a 95% rejection of polyvinyl alcohol size is provided by the hyperfiltration units employed, that a 10% size concentration is to be obtained, that effluent is delivered from the desizing washer at 1% concentration, and that effluent is delivered at a rate of 100 gallons per minute. Under these conditions a plot of the number of stages (N) against the fraction of size recovered (rT) shows that recovery initially improves substantially as the number of stages is increased, while the related FIG. 3 curves show that at the same time the number of hyperfiltration units or loops required (nT) decreases substantially along with the plant cost per pound of size recovered.

As the FIG. 3 curves indicate that the major advantage of staging is obtained with four stages, the FIG. 4 curves plot the percentage size concentration obtained against the same factors on the assumption that four stages are used with other conditions remaining the same. The decreasing fraction of size recovered (rT) that appears in FIG. 4 with increasing size concentration recovery (KCN) is a reflection of the greater opportunity for degraded size portions to pass through the filtration surfaces with the permeate as the total number of hyperfiltration units or loops (nT) is increased to obtain higher size concentration recovery; and, as was true in FIG. 3, the indicated FIG. 4 plant cost per pound of size recovered correlates with the number of loops required (nT).

In staging the hyperfiltration units 20, an equal number of units or loops is arranged in each stage and the desizing effluent to be handled is divided equally between the first stage units which deliver to corresponding units of the next stage and so on while the concentrate outputs from the final stage are combined to proceed therefrom through the system. Thus, as 24 units or loops are indicated for the four stage conditions represented in FIGS. 3 and 4, each stage would contain six units or loops under these conditions and the 100 gallon per minute delivery of desizing effluent would be directed at the rate of 6¼ gallons per minute to each unit of the first stage for serial progress through the corresponding units of the following stages. It should be understood, of course, that the foregoing arrangement is the one indicated by the assumed conditions and the hyperfiltration arrangement will have to be designed in similar fashion for any differing set of conditions encountered. It should also be noted that when staging is employed only one injection pump 28 is required for each staged series of units and bactericide need not be added until the concentrate output from all the staged series has been pooled.

If the pooled concentrate output from the hyperfiltration means is to be reused it is preferably treated by a polishing filter, as indicated at 38 in FIG. 1, to insure a satisfactory evenness before being collected in one or more storage tanks as at 40 in FIG. 1. Such storage capacity should be equipped with heating means and with some means for keeping the stored concentrate in motion to prevent surface film formation. If the stored concentrate must be transferred to another location for reuse, the recovered size concentrate is shipped as such or it may be reduced to a dry state at a flaker as indicated respectively at 42 and 44 in FIG. 1. In any event, the recovered size concentrate is reused by moving it from storage, either directly or by one of the transfer arrangements noted above, to a sizing kettle 46. Since some of the size remains in the effluent permeate portion and there are normal system losses by reason, for example of incomplete size removal at washer 10, a virgin size supplement must be added at this stage, and it is for this reason that a compensating "blowdown" must be allowed elsewhere in the system as noted earlier. That is, as all of the size removed at washer 10 is retained either in the recycled effluent permeate or in the size concentrate recovered, addition of the virgin size supplement would cause a size buildup in the system unless a balancing "blowdown" is provided.

The virgin size supplement is added in the amount needed to bulk the amount of recovered size concentrate employed to 100%, and it has been found that loom efficiencies are equaled or bettered with recovered size mixes as compared with virgin size and that the mixture ratio is not critical. Thus, in comparative tests under identical and conventional weaving conditions with the various polyvinyl alcohol size mix ratios indicated in the following tabulation, the indicated loom efficiencies were obtained.

| | LOOM EFFICIENCIES OBTAINED WITH INDICATED VIRGIN/RECOVERED SIZE MIXES | | | |
|---|---|---|---|---|
| Test | 100/0 | 50/50 | 25/75 | 10/90 |
| 1 | 97.33 | 95.97 | 95.68 | 98.11 |
| 2 | 95.89 | 95.97 | 95.90 | 96.13 |

As FIGS. 3 and 4 show that size recovery can approach 90% with a treating system arranged according to the present invention, the feasible mix ratio will be in the order of 10/90 under usual circumstances. It is also notable that the wax or the like commonly added to virgin size as a lubricant is recovered by hyperfiltration with the size concentrate so that no more than a proportionate amount of such lubricant need to be added with the virgin size supplement and the indications are that no addition of lubricant with the supplement is needed unless the performance demands during weaving are particularly heavy.

Upon suitable preparation of the size mix at kettle 46 it is delivered to a slasher 48 for warp application and the sized warp yarn is then supplied to a loom 50 where filling yarn is added to produce a fabric that is desized at washer 10 to complete the treating system circuit. The result is a closed treating system by which compliance with restrictions against desizing effluent dumping is made possible in a practical manner by reconditioning a substantial portion of the effluent for recycling and by allowing recovery of a predominant portion of the size contained in the effluent for reuse, so that signicant savings in both washing liquid requirements and in size consumption may be realized.

FIGS. 5–10 of the drawings detail the particulars of a structural arrangement suitable for hyperfiltration modules 26 when used in the treating system of the present invention, and illustrate an improved sealing arrangement for such modules as developed for the purposes of the present invention. As shown, the modules 26 incorporate a bundle of elongate, porous carbon tubes 52 lined with semipermeable membranes of the sort noted earlier. This tube bundle is fixed in sealed relation within a chamber formed in principal part by a cylindrical housing 54 so that liquid to be filtered is directed in parallel through the tubes of the bundle. The improved tube sealing arrangement comprises closure members 56 fixed, as by welding, adjacent each end of housing 54 and having a pattern of apertures 58 formed therein for respective slip fit disposition of end portions of each tube 52 therethrough.

As the outer face of each closure member 56 a resilient O-ring 60 is disposed around each tube 52 and a face flange 62 having a corresponding pattern of apertures 64 formed therein for receiving the tube end portions is bolted in place over the O-rings 60 by means of studs 66 at which spacer elements or washers 68 are interposed (as seen best in FIG. 7) in a thickness proportioned to limit compression of O-rings 60 by the bolted face flanges 62 sufficiently to prevent destructive stressing of the tube end portions while allowing enough O-ring compression for effective external sealing of tubes 52 at the closure members 56.

Figure 8:
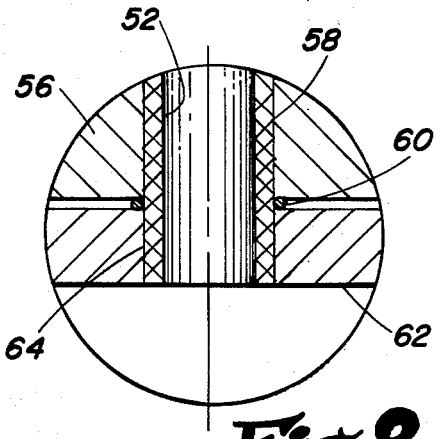
FIG. 8 is an enlarged sectional detail taken at the 8—8 circle in FIG. 5.
Figure 9:
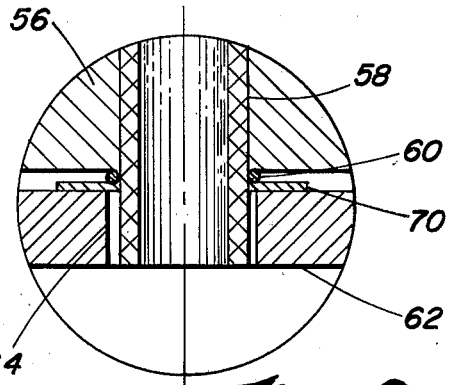
FIG. 9 is a corresponding section showing a modified arrangement of the FIG. 8 detail.
Figure 10:
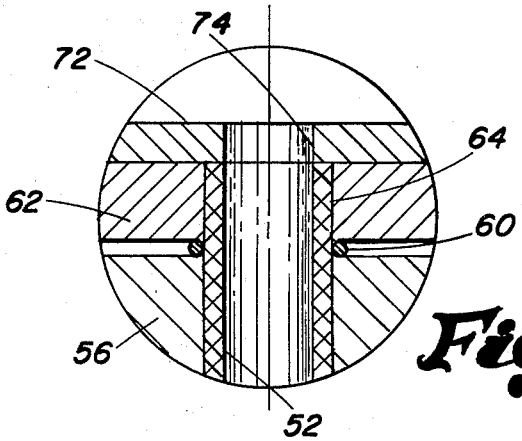
FIG. 10 is an enlarged sectional detail taken at the 10—10 circle in FIG. 5.

The apertures 64 in face flanges 62 may be formed like those in closure members 56 for slip fit reception of the tube end portions as illustrated in FIG. 8, or these apertures may be enlarged in relation to those in the closure members 56, as at 64' in FIG. 9, in which case a washer 70 is additionally disposed around each tube end portion over the O-ring sealing members 60 for compressing the same when the face flanges 62 are bolted in place. Provision of enlarged face flange apertures 64' as in the FIG. 9 arrangement provides the advantage of facilitating assembly of the face flanges 62 by rendering close alignment with the closure member apertures 58 and axial trueness of the tubes 52 less critical, but involves the disadvantage of requiring that a considerable number of the additional washers 70 be handled along with the O-rings 60. No matter which of the FIG. 8 or FIG. 9 face flange arrangements is used, an end plate 72 is additionally bolted along with the face flange 62 to the closure member 56 at the outlet end of the module 26, and this end plate 72 also has a corresponding pattern of apertures 74 formed therein that are of sufficiently smaller diameter than that of the hyperfiltration tubes 52 to maintain these tubes 52 in place against endwise thrust in the outlet direction without obstructing flow therethrough (see FIG. 10). As a matter of inactive assembly the tubes 52 are held in place adequately by the O-ring sealing members 60, but static pressure differential across the module 26 and dynamic pressure at the inlet side which develop during operation exert enough endwise thrust at tubes 52 to require opposing support by the illustrated end plate arrangement.

Figure 2:
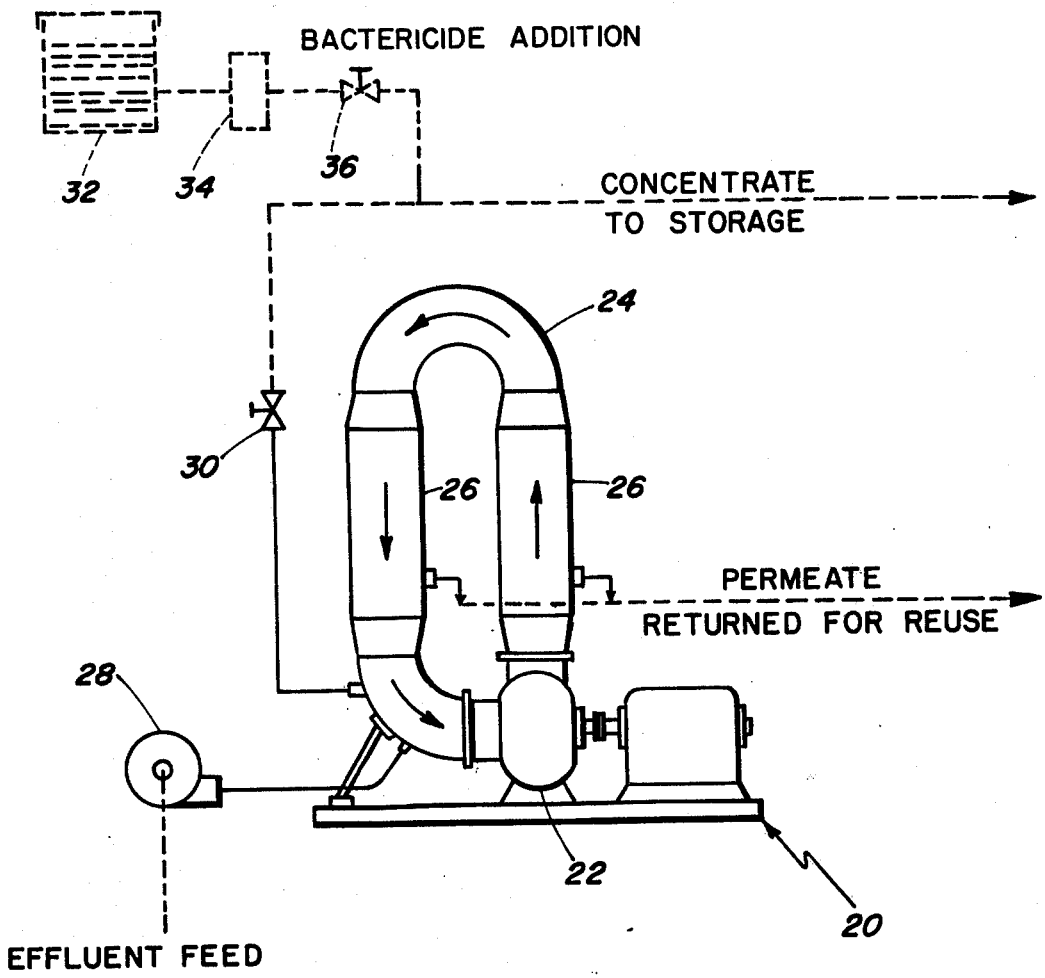
FIG. 2 is a schematic illustration of a representative hyperfiltration loop suitable for use in the treating system of the present invention.
Figure 5:
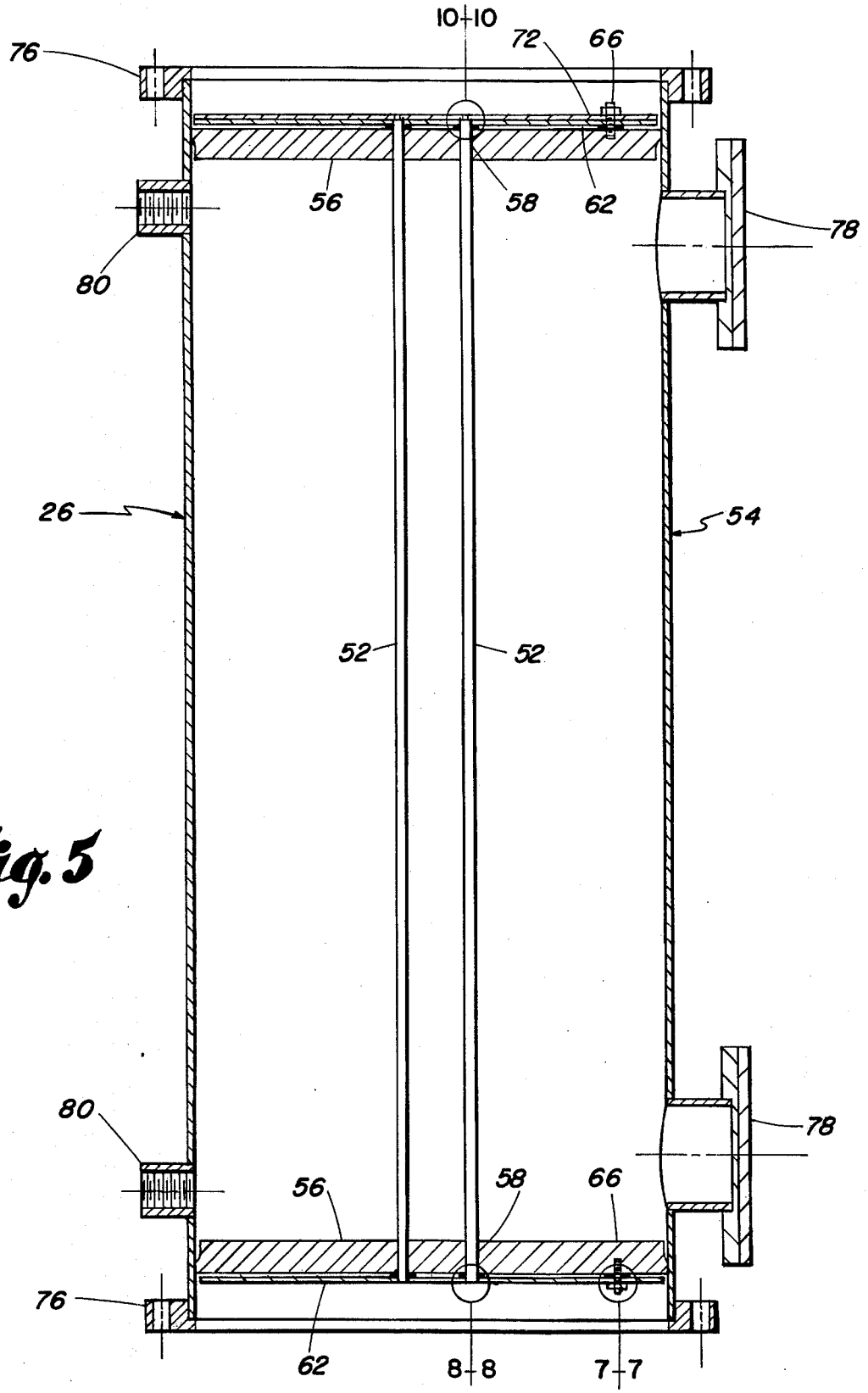
FIG. 5 is a central longitudinal section of a representative hyperfiltration module for use in a treating system loop.
Figure 6:
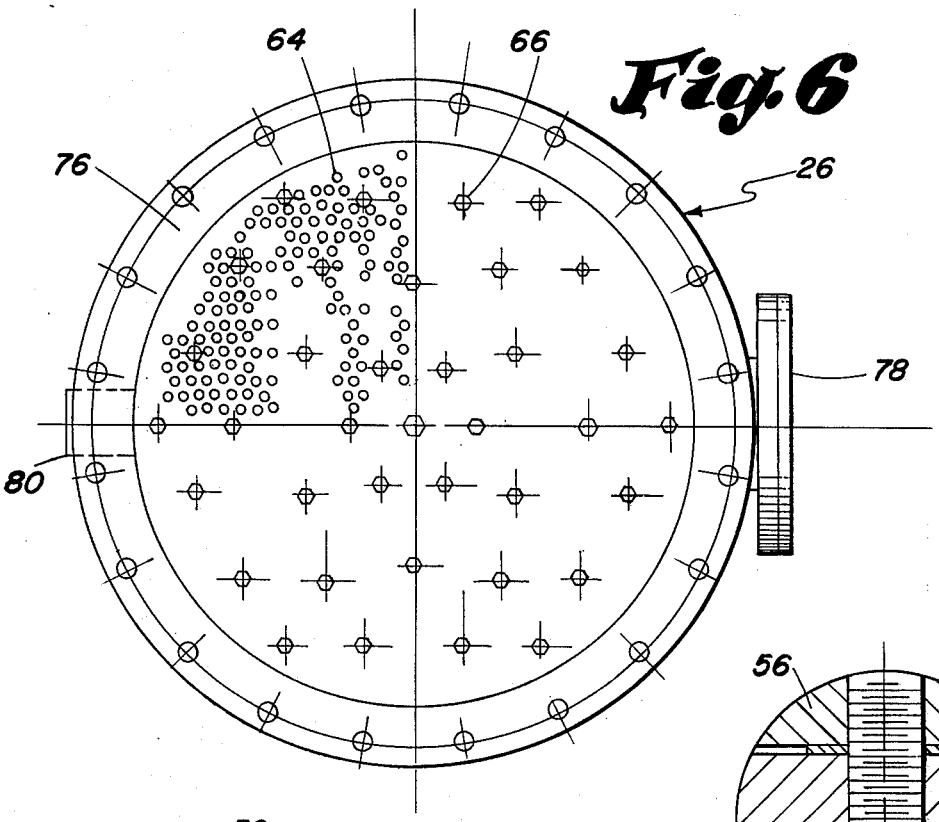
FIG. 6 is a bottom plan view corresponding to FIG. 5.
Figure 7:
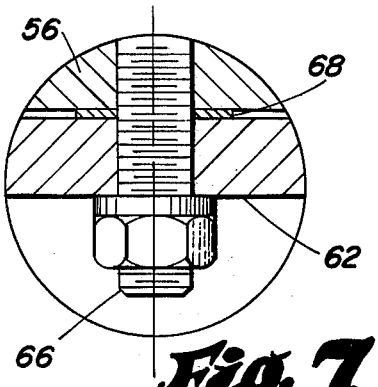
FIG. 7 is an enlarged sectional detail taken at the 7—7 circle in FIG. 5.

The module housing 54 is also fitted at each end with assembly flanges 76 by which modules 26 are installed in a hyperfiltration loop unit 24 such as is diagramed in FIG. 2, and has lateral access ports 78 as well as laterally opening pipe couplings 80 adjacent each end (see FIG. 5). The access ports 78 permit installation and maintenance access to the hyperfiltration tubes 52, while the pipe couplings 80 provide respectively for withdrawal of effluent permeate and venting of module 26 depending on the vertical orientation with respect to the direction of recirculating flow in loop unit 24. That is, the upper pipe coupling 80 in FIG. 5 would be used for venting the right loop unit leg in FIG. 2 and as a permeate outlet in the left leg.

While hyperfiltration means such as has been described at length above is preferred for use in the treating system of the present invention because of the advantageous selective size recovery it evidently allows, it should also be noted that there is significant advantage in the reconditioning of the desizing effluent by the treating system for recycling and that this advantage is obtained whether or not the size is recovered in reusable form. Accordingly, the foregoing exemplary disclosure based mainly on the arrangement and operation of a treating system employing hyperfiltration and handling polyvinyl alcohol size should not be understood to exclude the use of other size separation techniques when desired or to indicate that operating results are any less effective when other types of size must be handled.

I claim:

1. Apparatus for treating textile desizing effluent comprising means for maintaining said effluent at a substantially level size content, means at which said effluent is received as a feed for concentrating and separating a predominant portion of the effluent size content in an effluent concentrate portion, and means for recycling a remaining effluent permeate portion for textile desizing use, said concentrating and separating means being formed by a hyperfiltration system including at least four serially arranged stages yielding permeate in parallel and operating serially to increase the size content in and concentrate while passing degraded size with said permeate, the effluent feed to said serially arranged stages being initially and solely pressurized ahead of the first stage to control system pressure, and the size concentrate discharged at the last stage being controlled by valve means regulating said concentrate discharge suitably for reuse as textile sizing.

2. Apparatus as defined in claim 1 and further including means for filtering entrained foreign particles from said effluent prior to feeding the same for concentrating and separating size therefrom.

3. Apparatus as defined in claim 2 and further including means for receiving effluent from said filtering means and maintaining a feed supply thereof for delivery to said concentrating and separating means.

4. Apparatus as defined in claim 3 wherein said concentrating and separating means is a hyperfiltration system operating to concentrate size in said concentrate portion of said effluent on the basis of molecular weight.

5. Apparatus as defined in claim 4 wherein said hyperfiltration system comprises loop units incorporating means for injecting and recirculating effluent feed therein and valve means for controlling release of effluent concentrate from said recirculation at a desired concentration.

6. Apparatus as defined in claim 5 and further including means for storing size concentrate released from said hyperfiltration system for reuse in sizing textile material.

* * * * *

Disclaimer and Dedication 3,998,740.—*Curtis C. Bost, Eugene Scott Irwin*, Clemson; *Thomas M. Keineth, Robert Q. Russell*, Seneca; *Harsch C. Ince, Jr.* Greenville, South Carolina; *Gary L. Parsons*, Gastonia and *James Keith Turner*, Lincolnton, North Carolina. APPARATUS FOR TREATMENT OF TEXTILE DESIZING EFFLUENT. Patent dated Dec. 21, 1976. Disclaimer and dedication filed June 26, 1980, by the assignee, *J. P. Stevens & Co., Inc.*

Hereby disclaims and dedicates to the Public claims 1 through 6 of said patent.

[*Official Gazette August 26, 1980.*]